US005360205A

United States Patent [19]

Ellend

[11] Patent Number: 5,360,205

[45] Date of Patent: Nov. 1, 1994

[54] DRIVING ASSEMBLY FOR SLIDE GATE ON A METALLURGICAL VESSEL

[75] Inventor: Walter Ellend, Unterägeri, Switzerland

[73] Assignee: Stopinc Aktiengesellschaft, Baar, Switzerland

[21] Appl. No.: 90,536

[22] Filed: Jul. 13, 1993

[30] Foreign Application Priority Data

Jul. 17, 1992 [CH] Switzerland ..... 2258/92

[51] Int. Cl.[5] ..... B22D 41/38

[52] U.S. Cl. ..... 266/236; 222/600

[58] Field of Search ..... 266/236; 222/591, 597, 222/600

[56] References Cited

U.S. PATENT DOCUMENTS

| | | | |
|---|---|---|---|
| 3,937,372 | 2/1976 | Bode, Jr. | 222/600 |
| 4,199,085 | 4/1980 | Watts et al. | 222/600 |
| 4,421,256 | 12/1983 | Abarotin et al. | 222/600 |
| 5,129,555 | 7/1992 | Fricker | 222/600 |

FOREIGN PATENT DOCUMENTS

| | | | |
|---|---|---|---|
| 0047538 | 3/1982 | European Pat. Off. . | |
| 0574275 | 9/1977 | U.S.S.R. | 222/600 |

*Primary Examiner*—Scott Kastler
*Attorney, Agent, or Firm*—Wenderoth, Lind & Ponack

[57] ABSTRACT

A driving assembly for moving a slidable member of a slide gate on a metallurgical vessel includes a thrust rod of the slide to be moved in opposite directions, a movable drive unit, at least one deflection member to be pivoted to the vessel and connecting the drive unit to the thrust rod to transduce movement of the drive unit to movement of the thrust rod, and a guide unit to prevent cross or transverse forces from the drive unit and/or deflection member from being imparted to the thrust rod. The guide unit engages the thrust rod approximately at an outer end thereof and guides and supports the thrust rod over the entire length of movement thereof.

19 Claims, 2 Drawing Sheets

10
12'
24
24'
52
53
50
15
21
42
21'
40
54
51
41
16
P3
P1

DRIVING ASSEMBLY FOR SLIDE GATE ON A METALLURGICAL VESSEL

BACKGROUND OF THE INVENTION

The present invention relates to a driving assembly for moving a slidable member of a slide gate on a metallurgical vessel, the assembly being of the type including a thrust rod of the slide that is to be moved in opposite directions, a drive unit that is movable, for example in directions different from that of movement of the thrust rod, and at least one deflection member to be pivoted to the vessel and connecting the drive unit to the thrust rod to transfer or transduce movement of the drive unit to movement of the thrust rod.

A driving assembly of this general type is disclosed in EP-A1 0 047 538 and is operable to open and close a slide gate. A drive unit is mounted on the side of a metallurgical vessel and is manually operable. Movement of the drive unit generally vertically is transduced or transferred by way of a simple lever system into generally horizontal movement of a thrust rod of a slide of the slide gate. The lever system includes a toggle lever that is pivoted at approximately a center thereof to the metallurgical vessel. One end of the toggle lever is hinged to a vertical rod that is part of or driven by the drive unit, and the other end of the toggle lever is hinged to a horizontal rod that is part of or connected to the thrust rod of the slide of the slide gate. The toggle lever thus is rotated about its pivot axis, with the result that the thrust rod and the slide are moved back and forth in opposite directions. The connecting point of the toggle lever with the thrust rod is caused to be moved along a circular arc. The thrust rod however must be moved only rectilinearly. Therefore, a connecting rod or lever is connected between the toggle lever and the thrust rod. However, one disadvantage of this lever system is the generation of relatively large transverse or cross forces that act from the toggle lever on the thrust rod. On the one hand, the existence of such forces requires that the thrust rod be mounted in a relatively massive bearing. On the other hand, practical operations and installations repeatedly have demonstrated that, despite such relatively massive bearings, such forces can lead to jamming of the thrust rod or to heavy wear of such bearings. Furthermore, in the case of large slide gates, it is necessary to employ powered drive units, for example hydraulic piston-cylinder units. When using such units, the transverse or cross forces that are generated are significantly larger. As a result, the application of such larger forces to the thrust rod of the slide cause jamming or wear of the bearing to occur even sooner.

SUMMARY OF THE INVENTION

With the above discussion in mind, it is an object of the present invention to provide an improved driving assembly of the general type mentioned above, but whereby it is possible to overcome the above and other prior art disadvantages.

It is a further object of the present invention to provide such a driving assembly that is improved by simple engineering principles with the result that the above discussed transverse or cross forces acting on the thrust rod of the slide of the slide gate can be virtually eliminated, with the result that malfunctions of operation of the thrust rod can be drastically reduced.

These objects are achieved in accordance with the present invention by the provision of a guide unit that engages the thrust rod of the slide approximately at an outer end thereof and that supports and guides the thrust rod over the entire stroke or length of movement thereof in opposite directions, for example rectilinear directions.

In the above described conventional arrangement wherein the thrust rod includes a support bearing, the largest moments resulting from the transverse or cross forces are generated primarily when the thrust rod is moved completely outwardly relative to the slide gate. With the above mentioned improvement of the present invention, the transverse or cross forces and thus moments generated thereby and acting on a bearing of the slide gate can be reduced to a minimum. For this reason, the life of the thrust rod bearing is extended significantly. Further, the thrust rod bearing can be dimensioned to be of much smaller size than in known arrangements. Even further, the thrust rod bearing can be eliminated entirely.

The guide unit of the present invention that carries or supports and guides the thrust rod of the slide of the slide gate is attached to the metallurgical vessel independently of the slide gate. In previously known arrangements, there are installations wherein the drive unit is mounted on the side of the metallurgical vessel with the movement of the drive unit being in a different direction, for example vertical, than the direction of movement of the thrust rod, for example horizontal. Also known are arrangements wherein the drive unit is connected directly to the thrust rod, for example mounted adjacent the bottom of the vessel, with movement of the drive unit being parallel to the movement of the thrust rod. It has been necessary in the past to provide the slide gates for these two different arrangements with housings specifically designed for the particular drive unit arrangement. Thus, two different slide gate housings have been necessary. However, in accordance with the improved driving assembly of the present invention, the same slide gate housing can be employed for either type of driving assembly mounting arrangement. This is due to the fact that the guide unit of the present invention is mounted independently of the slide gate housing and also in view of the fact that the same slide thrust rod can be employed in either type of driving assembly mounting arrangement. Thus, it is not necessary to provide special and different thrust rod bearings for the two different driving assembly mounting arrangements. The result is substantial cost savings and simplification in the number of structural elements necessary for the overall slide gate installation.

In accordance with one embodiment of the present invention, the guide unit comprises at least one steering lever and at least one connecting lever, the steering lever having a first end pivoted to the outermost end of the thrust rod and a second end pivoted to a first end of the connecting lever, and a second end of the connecting lever being pivotable to the vessel. The steering lever has formed approximately in the center of the longitudinal length thereof a longitudinal slot. A pin is fixable to the vessel and extends into the slot. The steering lever therefore is capable simultaneously of rotatable movement about the pin and movement longitudinally relative thereto along the slot. By this arrangement, the thrust rod is guided completely by the guide unit as the thrust rod moves between its opposite final end positions. The guide unit absorbs entirely the transverse or cross forces that are generated from the deflection element. Therefore, there results a significantly better distribution of force. More particularly, the force from the drive unit effectively is caused to act on the end of the thrust rod substantially entirely in a direction longitudinally thereof, without the imposition on such thrust rod end of the transverse or cross forces as occurred in conventional arrangements.

In accordance with a further embodiment of the present invention, the guide unit comprises a guide rail to be mounted on the metallurgical vessel. The guide rail has a longitudinal slot guiding the outermost end of the thrust rod. Particularly, the end of the thrust rod has extending therefrom a transverse pin that extends into the slot and is guided thereby. As a result, the guide rail absorbs any transverse or cross forces that are generated by the deflection member, and the forces imparted to the thrust rod are coaxial thereof.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
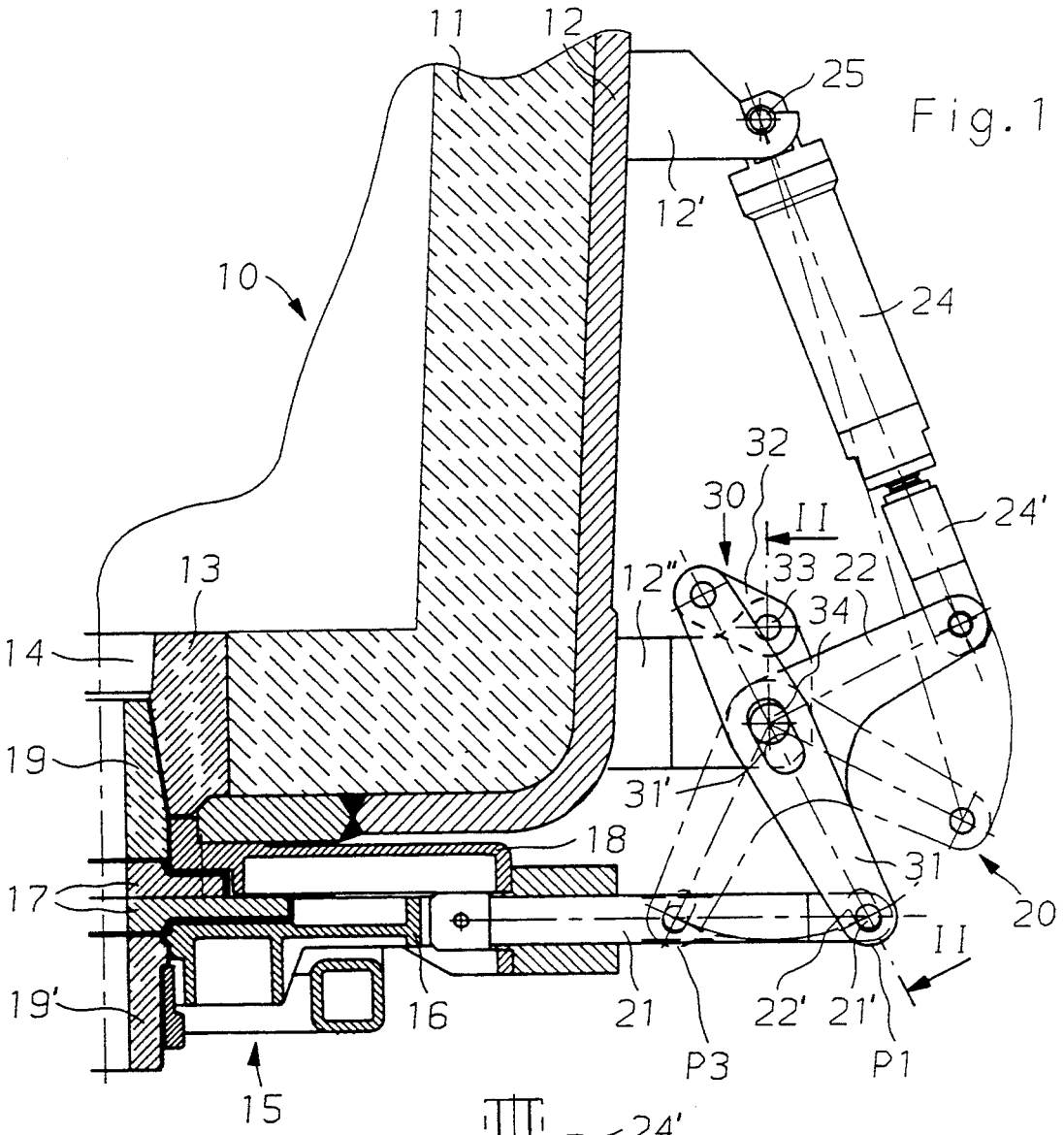
FIG. 1 is a fragmentary sectional view of a metallurgical vessel having mounted thereon a slide gate and incorporating a driving assembly in accordance with a first embodiment of the present invention.

Shown schematically in FIG. 1 is a metallurgical vessel 10 intended to contain molten metal, for example a ladle in a steel work and intended to contain molten steel. Vessel 10 includes an outer wall or jacket 12 formed of sheet steel and an inner refractory lining 11. A commercially available perforated brick 13 defines an outlet spout 14, discharge of molten metal therefrom being controlled by a sliding closure unit or slide gate 15. Slide gate 15 may include, as is known, a housing 18 mounted on the vessel bottom, a pair of refractory slide members 17, the upper of which is fixedly mounted and the lower of which is slidable by means of a slide 16 mounted for sliding movement within housing 18, and upper and lower refractory sleeves 19, 19'. The structure and operation of such slide gate are well known and will not be further discussed in detail. It furthermore is to be understood that other conventional slide gate structures may be adapted to incorporate the improved driving assembly of the present invention.

The reciprocating slide 16 has connected thereto a thrust rod 21 as is known and that forms part of the improved driving assembly of the invention. The driving assembly of the invention furthermore includes a drive unit, for example a piston-cylinder unit 24, that is hinged, for example at 25, to a fishplate 12' of the vessel. A deflection member 22, for example in the form of a toggle lever or L-shaped lever, is pivoted at a pin 34 that is fixed to a support 12'' of the vessel. One end of lever 22 is hinged to a thrust rod 24' of the piston-cylinder unit 24. The other end of lever 22 is hinged to the outer end of thrust rod 21, for example by being pivotally mounted about an axle or pin 21' at the thrust rod end.

In further accordance with the driving assembly of this embodiment of the present invention, there is provided a novel guide unit 30 that engages the thrust rod, particularly the outermost end thereof, and guides the thrust rod over the entire length of movement thereof in opposite rectilinear directions. Particularly, the guide unit 30 ensures that the force from drive unit 24 is imparted to the thrust rod 21 in a direction substantially entirely coaxially thereof, and without imparting transverse or cross forces to thrust rod 21. Guide unit 30 includes a steering lever 31 and a connecting lever 32. A first end of steering lever 31 is pivoted to the outer end of the thrust rod 21, i.e. at pin or axle 21'. A second end of steering lever 31 is pivoted to a first end of connecting lever 32. A second end of connecting lever 32 is pivoted about pin or axle 33 to support 12'' of vessel 10. Steering lever 31 has formed approximately in the center of the longitudinal length thereof a longitudinal slot 31' within which fits pin 34. Pin 34 fits within slot 31' without play in a direction transverse to the longitudinal length of slot 31', but lever 31 is movable relative to pin 34 along the length of slot 31'. The angled deflection member 22 is pivoted without play to thrust rod 24'. Deflection member 22 in the opposite end thereof has a longitudinal slot 22' into which extends axle or pin 21' at the end of thrust rod 21. Pin 21' fits without play in a direction transverse to slot 21', but member 22 is movable relative to pin 21' along the length of slot 22'.

FIG. 1 illustrates the positions of the elements by solid lines in an outermost final or end position P1 of thrust rod 21. At such position, pin 34 is located in an upper end region of longitudinal slot 31'. It will be apparent that the steering lever 31 is guided with additional and greater stability by the provision of the pin 34 fitting into slot 31'. It will be further apparent that as movement occurs from end position P1 to end position P3, lever 31 moves relative to pin 34 along the length of slot 31'. Further illustrated in FIG. 1 is a circular arc path of movement of the lower end of deflection member 22. However, due to the provision of longitudinal slot 22', pin 21' is not forced to move along such circular arc, but rather is enabled to move in precisely the rectilinear path of movement desired for thrust rod 21.

Figure 2:
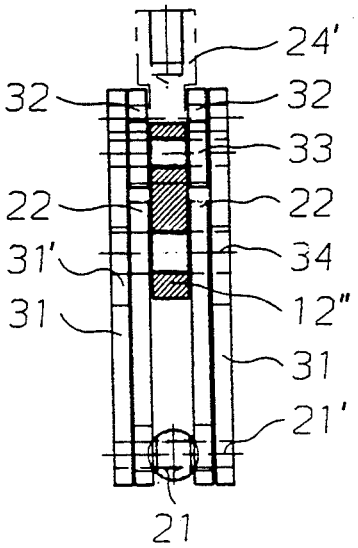
FIG. 2 is a sectional view taken along line II—II of FIG. 1.

As shown in FIG. 2, this embodiment of the present invention may incorporate parallel arrangements, on each of opposite lateral sides of thrust rod 21, of a steering lever 31, a connecting lever 32 and a deflection member 22. Such arrangement has the advantage that no additional force moments from axis 33 to axis 21' are produced that could result in the use of only one such lever arrangement. In principle however, the present invention may employ only one such lever arrangement. As further is apparent from FIG. 2, the steering levers 31 and the deflection members 22 are rotationally connected to axis 21' of thrust rod 21. Further, deflection members 22 are held on axis 34 of support 12''. Steering levers 31 can be rotated relative to connecting levers 32, and connecting levers 32 can be rotated about axis 33 on support 12''.

The driving assembly 20 described above results in the significant advantage that thrust rod 21 of slide 16 of slide gate 15 is held and supported and is carried or guided at the outermost end of thrust rod 21 by guide unit 30, and this occurs over the entire stroke or length of movement of thrust rod 21. The ratio of the lengths of the steering lever 31 to the connecting lever 32 is chosen in such a manner that the steering lever 31 is moved approximately rectilinearly over the entire displacement path at the bearing with axis 21'. This ratio can be determined empirically in a very simple manner and of course depends on the specific dimensions of a given installation. This ratio preferably is from 8:1 to 4:1, and in the illustrated arrangement is 5:1, with steering lever 31 moving by a maximum angle of 30°. Guide unit 30 requires only very little space and can be integrated into an existing deflection member.

If piston-cylinder unit 24 is actuated to cause movement from end position P1 to the opposite end position P3, then steering lever 31 and deflection member 22 are moved from position P1 to position P3. Between axis 21' and deflection member 22 there is provided relative movement or motion by the provision of longitudinal slot 22'. Cross forces acting from deflection member 22 largely are absorbed by the guide unit 30 during displacement. The forces acting on thrust rod 21 essentially are coaxial thereof and are not the previously inherent transverse or cross forces. Thus, the load on a bearing of the thrust rod in housing 18 significantly is relieved. Moreover, rotation of the drive unit about axis 25 is reduced due to the motion of deflection member 22. The sequence of motion between drive unit 24 and thrust rod 21 is restricted to occur in one plane, i.e. a plane parallel to the sheet of the drawing of FIG. 1.

Figure 3:
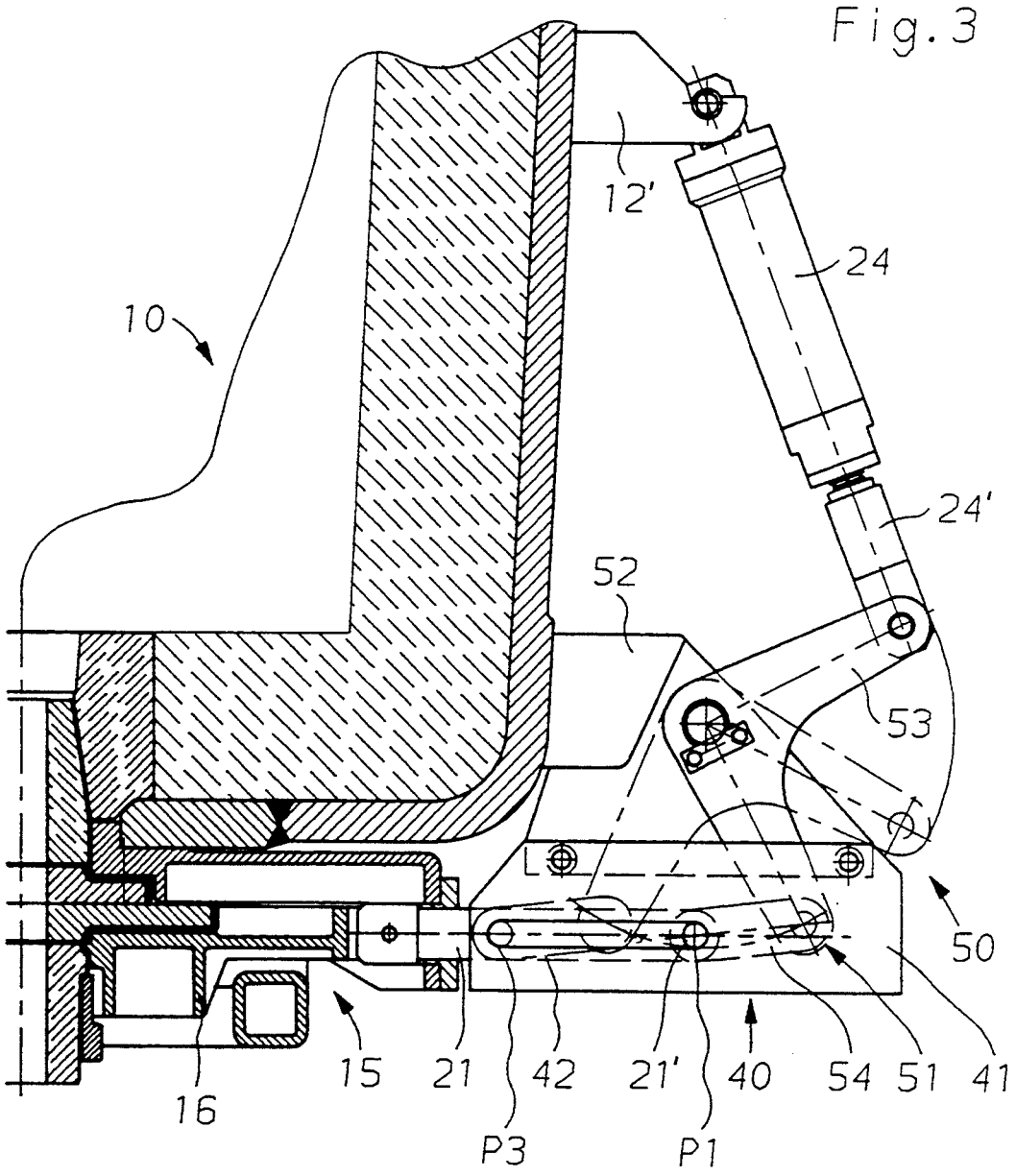
FIG. 3 is a view similar to FIG. 1 but of a further embodiment of the present invention.

Another embodiment of a driving device 50 according to the present invention is illustrated in FIG. 3. The structural elements of driving device 50 are the same as those of driving device 20 of FIG. 1, with the exception that this embodiment employs a different guide unit 40 and a somewhat different deflection member 51. Particularly, deflection member 51 is in the form of a toggle lever 53 pivoted on a support 52 of the vessel and a connecting rod or lever 54. Toggle lever 53 is hinged at one end thereof to thrust rod 24' of piston-cylinder unit 24. Toggle lever 53 is pivoted at the opposite end thereof to connecting rod 54. The other end of connecting rod 54 is pivoted on axis 21' at the end of thrust rod 21. The guide unit 40 is in the form of a guide rail 41 that is detachably attached to support 52 independently of slide gate 15. Guide rail 41 has therein a longitudinal slot 42 that is parallel to the thrust rod 21 and to the direction of rectilinear movement thereof. Axis 21', in the form of a pin or axle, extends into slot 42 and is guided thereby.

Forces generated by piston-cylinder unit 24 can be of up to some tons and would generate substantial cross or transverse forces on thrust rod 21, but for the provision of guide unit 40. The greatly major portion of these forces is absorbed by the simple construction of guide unit 40. More particularly, the outermost end of thrust rod 21 is guided throughout the entire stroke or length of movement between opposite end positions P1, P3 by longitudinal slot 42. Thus, the length of slot 42 corresponds to the entire stroke of movement thrust rod 21. In an advantageous arrangement of the embodiment of FIG. 3, guide rails 41 are provided on each of opposite lateral sides of thrust rod 21, and axis 21' extends into both slots 42 of the two guide rails 41. In such arrangement, connecting rod or lever 54 and toggle lever 53 are arranged between such two guide rails 41.

Although preferred embodiments of the present invention have been described and illustrated, it will be understood by one of ordinary skill in this art that various changes and modifications may be made to the specifically described and illustrated arrangements without departing from the scope of the present invention.

I claim:

1. In a driving assembly for moving a slidable member of a slide gate on a metallurgical vessel, said driving assembly including a thrust rod of the slide gate, said thrust rod to be moved in opposite directions, a movable drive unit, and at least one deflection member to be pivotally connected to the vessel, said at least one deflection member being connected to said drive unit to be pivoted by movement thereof and transducing said movement of said drive unit to movement of said thrust rod, the improvement comprising:

said thrust rod having at an outer end thereof an axle;

said at least one deflection member being connected to said axle; and a guide unit engaging said axle and causing pivotal movement of said at least one deflection member to be transferred to said axle as substantially rectilinear movement over the entire length of movement of said axle and said thrust rod in said opposite directions.

2. The movement claimed in claim 1, wherein said guide unit is mountable on the vessel independently of the slide gate.

3. The improvement claimed in claim 1, wherein said deflection member and said guide unit engage said axle at a common axis.

4. The improvement claimed in claim 1, wherein said guide unit comprises at least one steering lever and at least one connecting lever, said steering lever having a first end pivoted to said axle and a second end pivoted to a first end of said connecting lever, and a second end of said connecting lever being pivotable to the vessel.

5. The improvement claimed in claim 4, wherein said steering lever has formed approximately in the center of the length thereof a longitudinal slot, and further comprising a pin fixable to the vessel and extending into said slot, such that said steering lever simultaneously is rotatable about said pin and is movable longitudinally relative thereto.

6. The improvement claimed in claim 4, wherein the ratio of the length of said steering lever to the length of said connecting lever is from 8:1 to 4:1.

7. The improvement claimed in claim 4, comprising, on each of opposite lateral sides of said end of said thrust rod, a respective said deflection member, a respective said steering lever and a respective said connecting lever in parallel alignment.

8. The improvement claimed in claim 1, wherein said deflection member has a first end hinged to said drive unit and a second end hinged to said axle.

9. The improvement claimed in claim 8, wherein said second end is hinged to said axle without play in said directions of movement of said thrust rod and with play in directions transverse to said directions of movement of said thrust rod.

10. The improvement claimed in claim 9, wherein said second end has therein a slot elongated in said transverse directions and into which extends said axle.

11. The improvement claimed in claim 8, wherein said deflection member comprises a toggle lever.

12. The improvement claimed in claim 8, wherein said drive unit comprises a piston-cylinder assembly including a drive rod, and said first end of deflection member is pivoted to said drive rod.

13. The improvement claimed in claim 1, wherein said guide unit comprises a guide rail to be mounted on the vessel, said guide rail having a longitudinal slot in which is guided said end of said thrust rod.

14. The improvement claimed in claim 13, wherein said slot extends rectilinearly parallel to said opposite directions of movement of said thrust rod.

15. The improvement claimed in claim 14, wherein said axle extends into and is guided in said slot.

16. The improvement claimed in claim 15, wherein said deflection member is connected to said axle by a connecting lever having a first end pivoted to said axle and a second end pivoted to said deflection member.

17. The improvement claimed in claim 13, wherein said deflection member comprises a toggle lever having a first end hinged to said drive unit and a second end hinged to said axle by a connecting lever.

18. The improvement claimed in claim 17, wherein said drive unit comprises a piston-cylinder assembly including a drive rod, and said first end of said toggle lever is pivoted to said drive rod.

19. The improvement claimed in claim 1, wherein the direction of movement of said drive unit is different from that of said thrust rod.

* * * * *